US005938540A

United States Patent [19]

Lu

[11] Patent Number: 5,938,540

[45] Date of Patent: Aug. 17, 1999

[54] GOLF CLUB WITH INTERCHANGEABLE SOLE

[76] Inventor: Clive S. Lu, 282 Newbridge Rd., Hicksville, N.Y. 11801

[21] Appl. No.: 09/013,891

[22] Filed: Jan. 27, 1998

[51] Int. Cl.[6] ..... A63B 53/04

[52] U.S. Cl. ..... 473/288; 473/334; 473/338; 473/409

[58] Field of Search ..... 473/334, 335, 473/336, 337, 338, 339, 349, 328, 288, 291, 409, 282

[56] References Cited

U.S. PATENT DOCUMENTS

| | | | |
|---|---|---|---|
| 1,128,288 | 2/1915 | Churchill . | |
| 1,774,590 | 9/1930 | Buhrke . | |
| 3,680,868 | 8/1972 | Jacob . | |
| 3,761,095 | 9/1973 | Thompson | 273/174 |
| 3,893,670 | 7/1975 | Franchi | 273/80.1 |
| 4,775,156 | 10/1988 | Thompson | 273/171 |
| 4,884,808 | 12/1989 | Retzer | 273/77 A |
| 5,386,996 | 2/1995 | Hiruta . | |
| 5,435,551 | 7/1995 | Chen | 273/80.3 |
| 5,439,223 | 8/1995 | Kobayashi . | |
| 5,509,660 | 4/1996 | Elmer | 473/288 |
| 5,518,243 | 5/1996 | Redman | 473/334 |
| 5,669,825 | 9/1997 | Shira . | |

*Primary Examiner*—Sebastiano Passaniti
*Attorney, Agent, or Firm*—Aquilino & Welsh

[57] ABSTRACT

A method of forming a customized golf club head having a selected ground engaging soleplate is disclosed. A conventional club head body having a heel, toe, upper surface, rear surface and ball striking face is formed with a cavity in the bottom surface. One of a plurality of ground engaging soleplates is selected to be permanently or removably attached to the club head body. A manufacturer may preproduce club heads with a cavity in the bottom and at a later time select a particular ground engaging soleplate depending upon customer demands. The invention also allows a golfer to select one of a wide variety of ground engaging soleplates in order to customize a golf club suitable for selected playing conditions.

7 Claims, 3 Drawing Sheets

FIG. 7
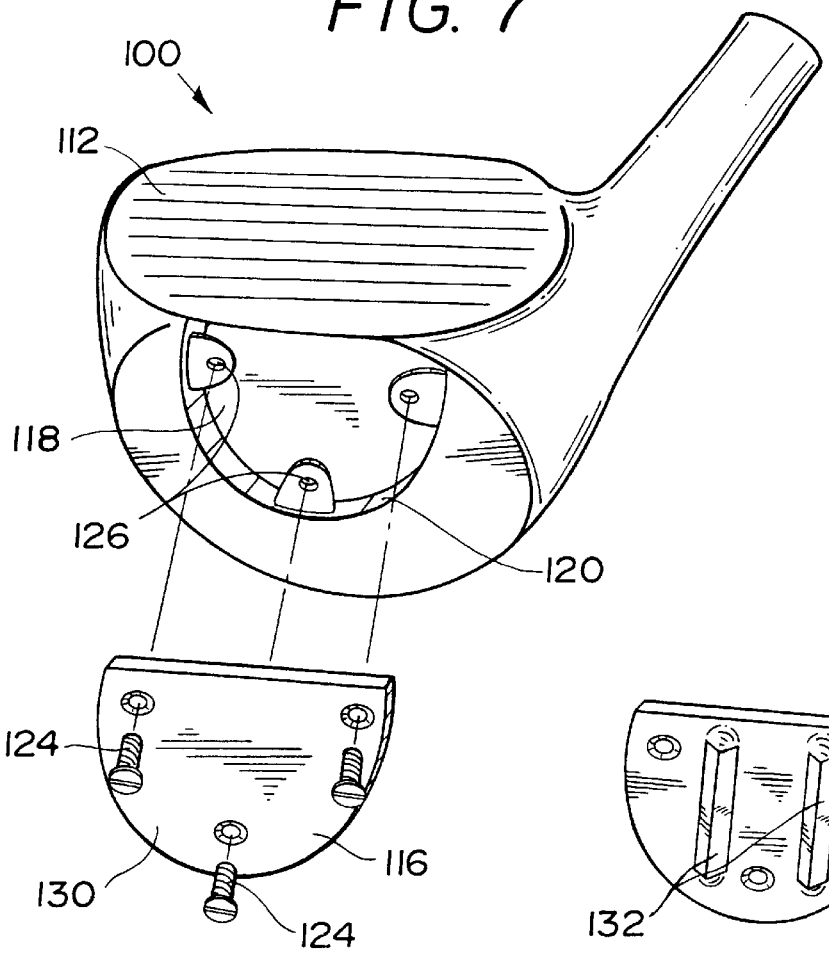
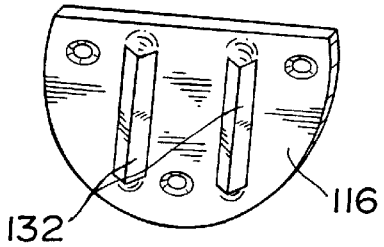
FIG. 8
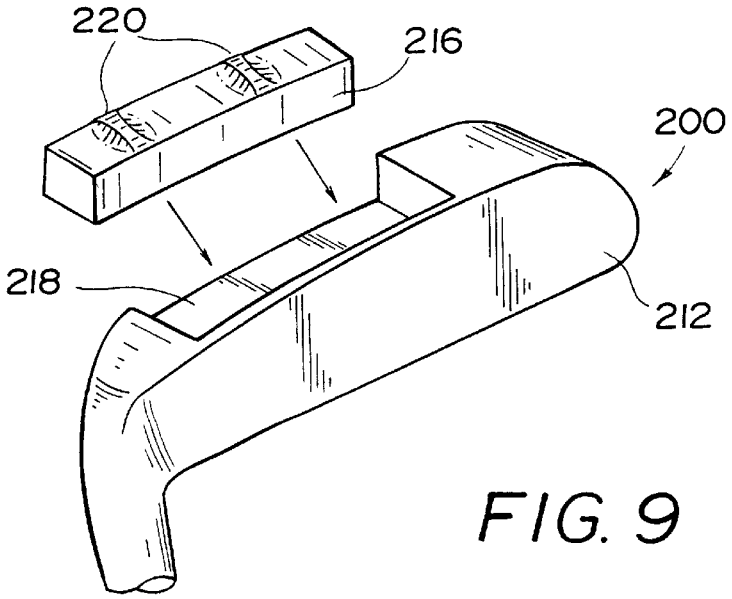
FIG. 9

GOLF CLUB WITH INTERCHANGEABLE SOLE

BACKGROUND AND SUMMARY OF THE INVENTION

The present invention relates to golf clubs and, more specifically, to a method of forming an improved golf club head structure with an interchangeable soleplate.

The playing characteristics of a particular golf club change depending upon the bottom surface or sole characteristics of the club head. For example, a wedge type golf club, having a first bounce or sole characteristic, will perform much differently from a similar club with another bounce angle or sole feature. By way of further example, a fairway wood type golf club head provided with runners, skids or keel structure will perform differently as the club engages the ground surface than a golf club without these members. Depending upon the individual using the golf club and the conditions where the golf club would normally be used, it may be desirable to have a particular type of soleplate configuration as opposed to another.

If a variety of bottom surface or soleplate characteristics are integrally formed with the club head, it necessarily follows that a large inventory of different type club heads must be made and stocked in order to satisfy various playing situations. This is expensive and creates inventory and storage problems from a manufacturing standpoint and requires that an individual golfer purchase a large number of golf clubs in order to have golf clubs available for a variety of different playing conditions.

Prior U.S. patents of interest include U.S. Pat. No. 5,509,660 to Elmer, which shows a golf club head having a removable ball striking face and sole portion. U.S. Pat. No. 4,775,156 to Thompson shows a golf club head having a sole plate defining a keel which is connected to the club head body by means of a bolt. U.S. Pat. No. 4,884,808 to Retzer shows a golf club head having an interchangeable face. U.S. Pat. No. 5,518,243 to Redman is directed to a wood type golf club having an interchangeable bottom weight.

The present invention relates to a golf club head having an interchangeable soleplate with a minimum of 20% of the total head weight. The club head is made in two parts, a first part being a generic club head body including a toe, heel, top surface, ball striking face, rear surface, connecting hosel, and a bottom cavity and a second part forming a soleplate which is attachable to the first part. The present invention contemplates having a bottom surface or soleplate which may be permanently or removably attached to the upper portion of the club head body, such as by mechanically connecting the parts with a screw or similar fastener, by permanently soldering, welding or brazing, or by adhesively bonding to permanently combine the two parts.

Among the objects of the present invention is the provision of a method for forming a golf club head having an interchangeable soleplate with a fixed shape, whereby the overall size and shape of the club head are the same and where the ground engaging characteristics of the bottom surface or sole are variable.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 7 is a bottom perspective view of a wood type club head in accordance with the present invention.

FIG. 8 shows an embodiment of an interchangable soleplate used with the club head of the present invention.

FIG. 9 is a bottom perspective view of a putter type club head in accordance with the present invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
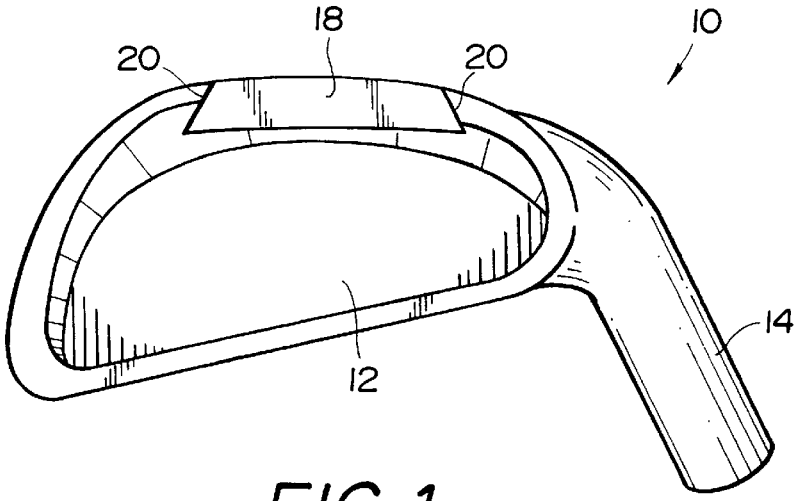
FIG. 1 is a rear elevational view of an iron type golf club head in accordance with the present invention.
Figure 2:
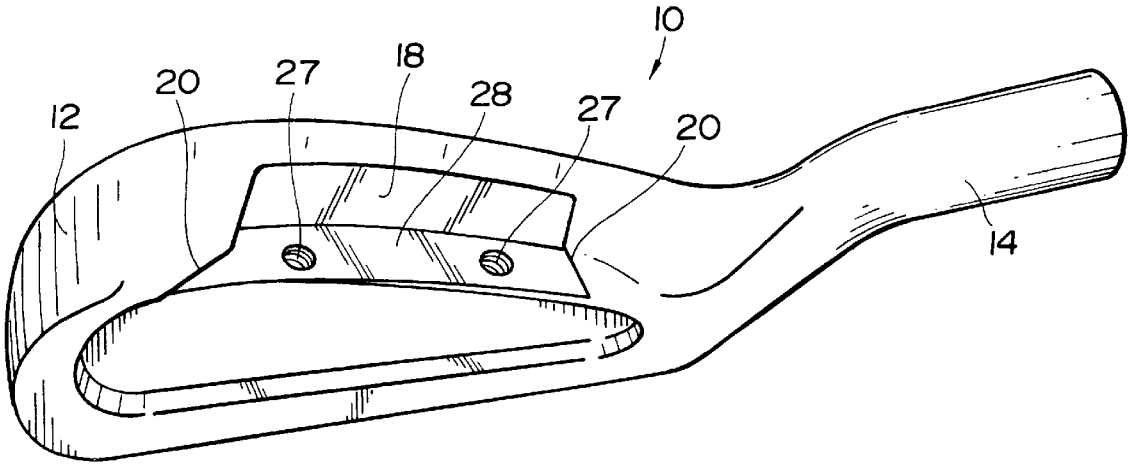
FIG. 2 is a bottom perspective view of the club head of FIG. 1.
Figure 3:
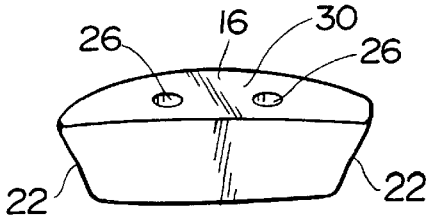
FIGS. 3, 4, 5, and 6 show various embodiments of interchangable soleplates used with the club head of the present invention.
Figure 4:
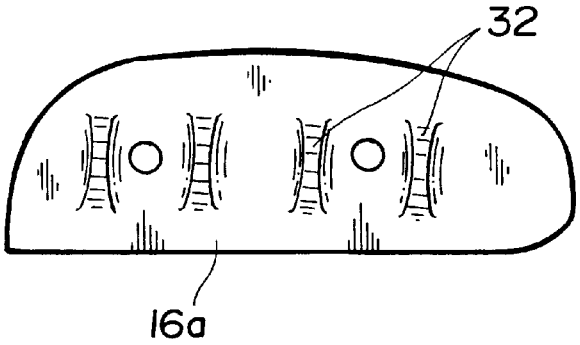
Figure 5:
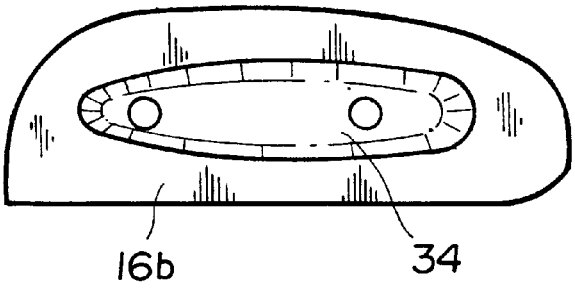
Figure 6:
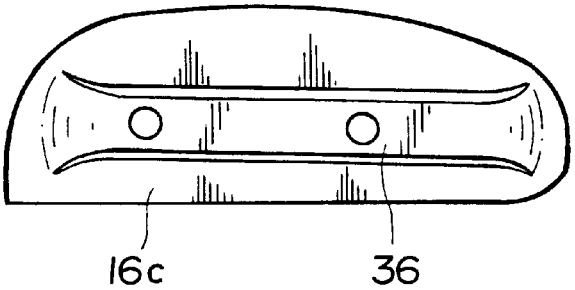

Referring to the drawings, FIGS. 1 and 2 show an iron type golf club head 10 in accordance with the present invention. The club head 10 includes a soleless generic club head body 12 including a hosel 14. An interchangeable soleplate 16 fits into a lower cavity 18 which is shaped to structurally receive the soleplate 16, formed in the body section 12. Preferably, the cavity 18 includes inwardly sloped, undercut side walls 20 which match corresponding end walls 22 on the soleplate 16. The soleplate 16 is designed to be inserted into the cavity 18 and secured by screws 24 inserted through threaded bores 26 in the soleplate 16 and threaded bores 27 in the lower wall 28 of the cavity 18. The soleplate 16 illustrated in FIG. 3 is planar in shape having a conventional flat ground engaging surface 30. FIGS. 4, 5, and 6 illustrate interchangable soleplates 16*a*, 16*b*, and 16*c* which also snugly fit within the cavity 18 of the club head 10. Soleplate 16*a* includes upright projections or runners 32. Soleplate 16*b* includes a concave ground engaging surface 34 whereas soleplate 16*c* includes a raised surface 36 to provide more bounce on the bottom of the club head 10. It will be appreciated that a wide variety of ground engaging surfaces may be provided on a similar number of alternately shaped bottom sole members.

In this embodiment, it is contemplated that the soleplates 16 may be interchangeable by loosening the screws 24 and simply sliding the soleplate 16 out of the cavity 18 and replacing the same with an alternate soleplate structure.

Thus, a player may experiment using a wide variety of different bottom surfaces depending upon the conditions, the desired shot pattern, ball flight characteristics, and so forth, that the individual golfer perceives to be advantageous for a particular game of golf.

Alternately the soleplates may be permanently attached by a club manufacturer by soldering, welding, brazing or adhesively attaching the soleplate at a factory location.

FIG. 7 illustrates a wood type golf club head 100 in accordance with the present invention formed of a club head body 112 having a cavity 118 formed on the bottom thereof and a detechable soleplate 116. It will be appreciated that the club head 100 may be a metal wood or a conventional wooden golf club. Due to weight considerations, the soleplate 116 is preferably a metallic plate which would fit into a grooved or undercut wall structure 120 in a cavity 118 on the bottom of the club head 100.

Soleplate 116 has a planar smooth ground engaging surface 130. As with the iron type structure, the soleplate 116 is attached by screws 124 into corresponding sockets 126, enabling the soleplate 116 to be removable and interchangeable in accordance with the playing characteristics required by a golfer. An alternative soleplate 116*a*, illustrated in FIG. 8, has a pair of runners 132 formed on the bottom of the soleplate 116*a*. Again, it will be appreciated that a wide variety of interchangeable soleplates may be provided in order to afford a golfer the opportunity of having a wide selection of golf clubs for different playing conditions.

FIG. 9 shows a putter type golf club head 200 in accordance with the present invention including a putter head body 212 and an interchangeable ground engaging soleplate 216. The soleplate 216, as shown, includes a pair of runners 220 which contact the putting surface during the execution of a putting stroke. As with the embodiments described hereinabove, the soleplate 216 may be flat or planar in shape or may be raised or otherwise configured. The soleplate 216 fits into a cavity 218 in the putter head body 212.

In this embodiment, the club head body 212 and ground engaging soleplate 216 are made of metallic material and are connected by soldering, welding or brazing to join the different parts together. Thus, once a particular ground engaging soleplate 216 is selected, it is permanently attached to the club head body 212. Alternately the soleplate 216 may be adhesively bonded by using heavy duty epoxies or the like, interacting with the surfaces of the two joined sections to form a permanent attachment once a particular ground engaging soleplate, having particular playing characteristics, is selected.

The method of forming a golf club by the present invention includes making a conventional generic club head body having a heel, toe, upper surface, rear surface, ball striking face and a cavity at the bottom of the club head. A preselected bottom surface is provided by selecting one of a plurality of ground engaging soleplates which are compatible with the club head body. The selection may be done at a factory location or by an individual golfer from one of the plurality of ground engaging sole plates. The selected soleplate is mechanically attached to the club head body in the cavity formed therein. The sole plate may be either permanently or removably attached. Should an individual golfer wish to change the playing characteristics of a particular club head wherein the sole plate is removably attached, he may select another ground engaging soleplates and, after removing the first, interchange the second with the first. Mechanically securing the second soleplate within the cavity provides a golf club with different playing characteristics. It will be appreciated that if the soleplates are carefully matched, particularly with respect to weight, the overall weight and swing characteristics of the club head should remain essentially constant even though the ground engaging surfaces differ. With this type of golf club, preferably a plurality of ground engaging sole plates are sold to an individual golfer, so that the golfer may customize his clubs to suit his needs. Alternately, the golf club may be sold with a single ground engaging soleplate with instructions to the golfer that the club may be retro-fitted by a club maker or golf club manufacturer at a later date.

It will be appreciated that the process is similar for irons, woods and putters. The only requirement necessary is that the ground engaging portions be readily interchangeable within each particular club head. With the present arrangement, both the bounce and radius of the sole may be regulated, as well as adding or deleting other ground engaging features such as runners, cavities and the like.

This method of making club heads is particularly attractive to manufacturers who must fill orders for large numbers of clubs. The present invention eliminates the necessity of stocking large numbers of finished golf clubs of popular designs, since any particular design may be made in accordance with the present invention.

Thus it can be seen that the above described invention permits selection of one of a wide variety of ground engaging surfaces for removable or permanent attachment to a pre-formed generic club head body. This provides an advance in the state of the art of making golf clubs which heretofore was limited to making a club having a single pre-selected, ground engaging, soleplate.

It will be appreciated that the present invention is equally applicable to any type of golf club head including irons, putters and wood type golf club heads. It will also be appreciated that any selected ground engaging surface may be formed on the ground engaging soleplate and subsequently attached to a generic type club head body to vary the playing characteristics thereof. Thus, the essence of the invention is providing a basic club configuration and altering the playing characteristics by providing a pre-selected ground engaging soleplate suitable for particular playing characteristics. The invention is not meant to be limiting to the various embodiments and structures shown hereinabove, but it may encompass any and all embodiments of golf club heads and methods of making the same in keeping within the scope of the following claims.

I claim:

1. A method of making a golf club head comprising the steps of:

forming a soleless generic golf club head having a heel, toe, upper surface, rear surface and ball striking face and a recessed cavity in a bottom surface of said club head;

selecting one of a plurality of ground surface engaging sole plates having a variety of surface, size, and shape configurations; said sole plate being formed with at least 20% of the total head weight of said golf club head;

and, attaching a selected one of said sole plates to said recessed cavity in the bottom surface of said club head body to form a unitized club head.

2. The method of claim 1, wherein said selected ground surface engaging soleplate is attached to said soleless generic golf club head with a mechanical fastener.

3. The method of claim 1, wherein said selected soleplate is removably attached to said club head body.

4. The method of claim 1, wherein said selected soleplate is permanently attached to said club head body.

5. The method of claim 1, wherein the step of attaching said pre-selected sole plate to the cavity formed in said club head body includes a step of welding.

6. The method of claim 1, wherein the step of attaching said selected soleplate to the cavity formed in said club head body includes a step of brazing.

7. The method of claim 1, wherein said selected soleplate is adhesively attached to said club head body.

* * * * *